US011653695B2

(12) United States Patent
Liu

(10) Patent No.: US 11,653,695 B2
(45) Date of Patent: May 23, 2023

(54) ATOMIZATION ASSEMBLY AND HOOKAH COMPRISING THE SAME

(71) Applicant: Tuanfang Liu, Shenzhen (CN)

(72) Inventor: Tuanfang Liu, Shenzhen (CN)

(73) Assignee: ASPIRE NORTH AMERICA LLC

( * ) Notice: Subject to any disclaimer, the term of this patent is extended or adjusted under 35 U.S.C. 154(b) by 338 days.

(21) Appl. No.: 17/019,395

(22) Filed: Sep. 14, 2020

(65) Prior Publication Data

US 2021/0177049 A1 Jun. 17, 2021

(30) Foreign Application Priority Data

Dec. 12, 2019 (CN) ..... 201911288940.4
Dec. 12, 2019 (CN) ..... 201922223164.1

(51) Int. Cl.

| | |
|---|---|
| ***A24F 1/30*** | (2006.01) |
| ***A24F 40/465*** | (2020.01) |
| ***A24F 5/08*** | (2006.01) |
| ***A24F 5/10*** | (2006.01) |
| ***A24F 5/04*** | (2006.01) |
| ***A24F 1/32*** | (2006.01) |
| *A24F 40/20* | (2020.01) |

(52) U.S. Cl.

CPC ..... *A24F 1/30* (2013.01); *A24F 5/04* (2013.01); *A24F 5/08* (2013.01); *A24F 5/10* (2013.01); *A24F 40/465* (2020.01); *A24F 1/32* (2013.01)

(58) Field of Classification Search

CPC ..... A24F 1/30; A24F 1/32; A24F 5/04; A24F 5/08; A24F 5/10; A24F 40/465

See application file for complete search history.

(56) References Cited

U.S. PATENT DOCUMENTS

2016/0227836 A1* 8/2016 Starkenburg ..... A24F 47/00
2017/0172203 A1* 6/2017 Gebara ..... A24F 5/00

FOREIGN PATENT DOCUMENTS

CN 110169596 A * 8/2019 ..... A24F 47/00
GB WO 2019/003117 A * 1/2019 ..... A24F 1/30
WO WO 2018/107497 A1 * 6/2018 ..... A24F 1/30

OTHER PUBLICATIONS

WO 2018107497 A1_English Machine Translation (Year: 2018).*
CN 110169596 A_English Machine Translation (Year: 2019).*

* cited by examiner

*Primary Examiner* — Michael J Felton
*Assistant Examiner* — Ronnie Kirby Jordan
(74) *Attorney, Agent, or Firm* — Matthias Scholl P.C.; Matthias Scholl

(57) ABSTRACT

An atomization assembly, including a high frequency heating module. The high frequency heating module includes a metal screen and a magnetic induction coil. The metal screen is disposed in the magnetic induction coil and is configured to heat a smoke material placed on the metal screen in a power-on state.

8 Claims, 5 Drawing Sheets

ATOMIZATION ASSEMBLY AND HOOKAH COMPRISING THE SAME

CROSS-REFERENCE TO RELATED APPLICATIONS

Pursuant to 35 U.S.C. § 119 and the Paris Convention Treaty, this application claims foreign priority to Chinese Patent Application No. 201911288940.4 filed Dec. 12, 2019, and to Chinese Patent Application No. 201922223164.1 filed Dec. 12, 2019. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure relates to an atomization assembly and a hookah comprising the same.

Conventional hookahs are driven by a built-in battery to produce an open fire to heat the smoke materials placed in the atomization assembly.

SUMMARY

The disclosure provides an atomization assembly, comprising a high frequency heating module; the high frequency heating module comprises a metal screen and a magnetic induction coil; the metal screen is disposed in the magnetic induction coil and is configured to heat a smoke material placed on the metal screen in a power-on state.

In a class of this embodiment, the high frequency heating module further comprises a magnet and a handle; the magnet is disposed on a top end of the metal screen and attracts the handle.

In a class of this embodiment, the high frequency heating module further comprises an isolation tube disposed between the metal screen and the magnetic induction coil thus isolating and protecting the magnetic induction coil; the isolation tube is a glass tube or ceramic tube.

In a class of this embodiment, the high frequency heating module further comprises a first seal ring and a second seal ring respectively disposed on two ends of the isolation tube to seal the metal screen.

In a class of this embodiment, the atomization assembly further comprises a first cover, a second cover, and a cup sleeve; the second cover is disposed on a top end of the high frequency heating module to cover the smoke material; the high frequency heating module is disposed in the cup sleeve; the first cover comprises an air vent and is disposed on the cup sleeve for air ventilation, and the handle is disposed on the first cover.

In a class of this embodiment, the atomization assembly further comprises a control panel, a power button, a funnel, a cup edge, a cup body, a silicone seal; the control panel is soldered on the magnetic induction coil of the high frequency heating module; the power button is disposed on the control panel; the funnel is disposed on the control panel to support the smoke material; the cup sleeve is disposed in the cup body; the cup edge is disposed on a periphery of the cup body to fix the cup sleeve; and the silicone seal is disposed on a bottom end of the cup body.

In a class of this embodiment, the atomization assembly is in the shape of a cup.

The disclosure also provides a hookah comprising the aforesaid atomization assembly.

The hookah further comprises a water container, a first air channel and a second air channel; the first air channel comprises a first end connected to the atomization assembly and a second end submerged below a liquid graduation line of the water container; the second air channel comprises a third end connected to a suction nozzle and a fourth end disposed above the liquid graduation line; when in use, the water container is filled with water; the smoke produced by the atomization assembly enters the water from the first end, is filtered by the water, escapes from the water, and flows to the suction nozzle.

The following advantages are associated with the hookah of the disclosure: the atomization assembly comprises a high-frequency heating module. According to the principle of electromagnetic induction heating, when the magnetic induction coil is electrified, an eddy current is produced in the metal screen disposed in the magnetic induction coil. In this way, a heat is produced to heat the smoke material.

DETAILED DESCRIPTION

To further illustrate, embodiments detailing an atomization assembly and a hookah comprising the same are described below. It should be noted that the following embodiments are intended to describe and not to limit the disclosure.

Smoke materials refer to smoke oil, tobacco, tobacco and other materials used to produce smoke.

Figure 1:
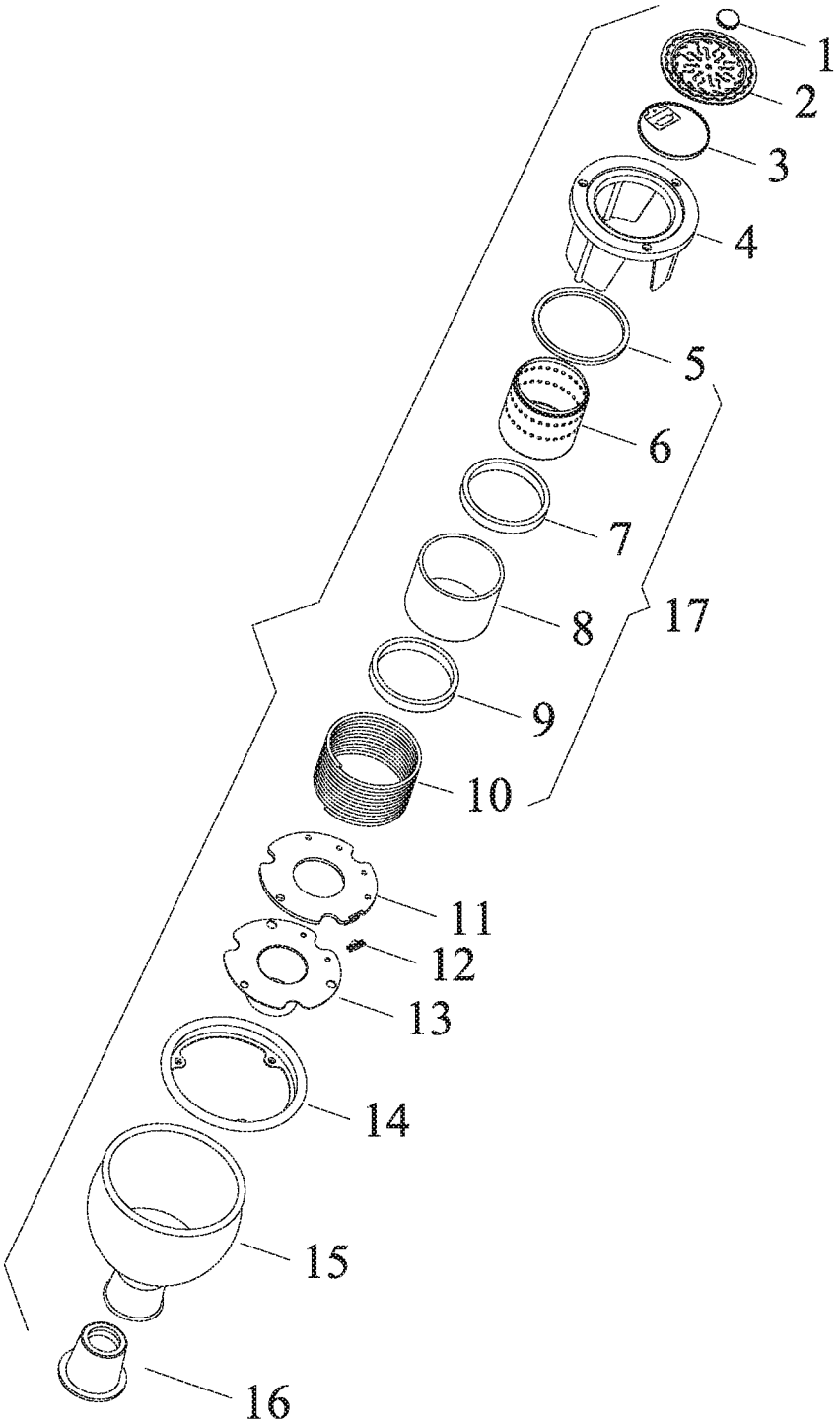
FIG. 1 is an exploded view of an atomization assembly according to one embodiment of the disclosure.
Figure 2:
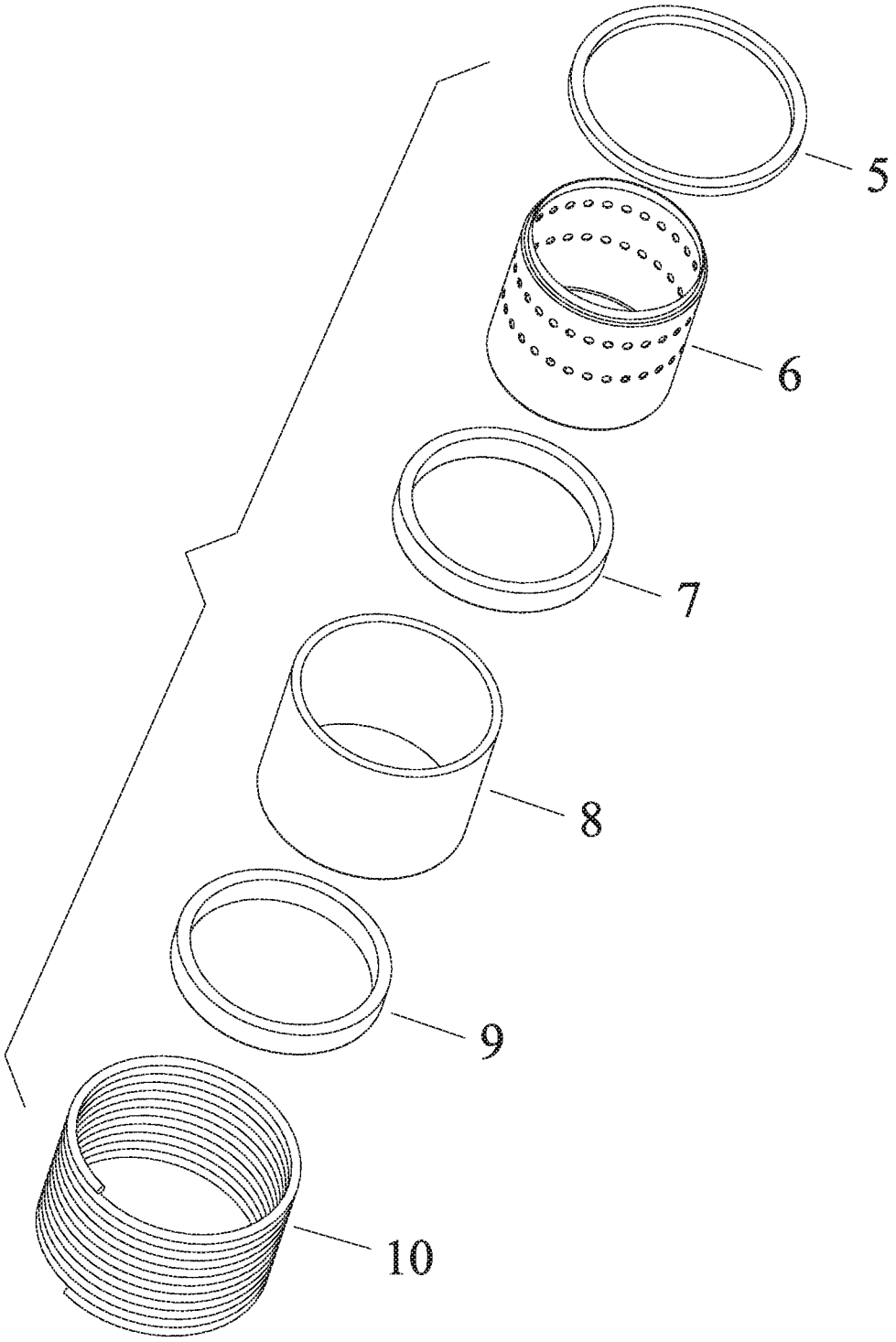
FIG. 2 is an exploded view of a high frequency heating module of an atomization assembly according to one embodiment of the disclosure.
Figure 3:
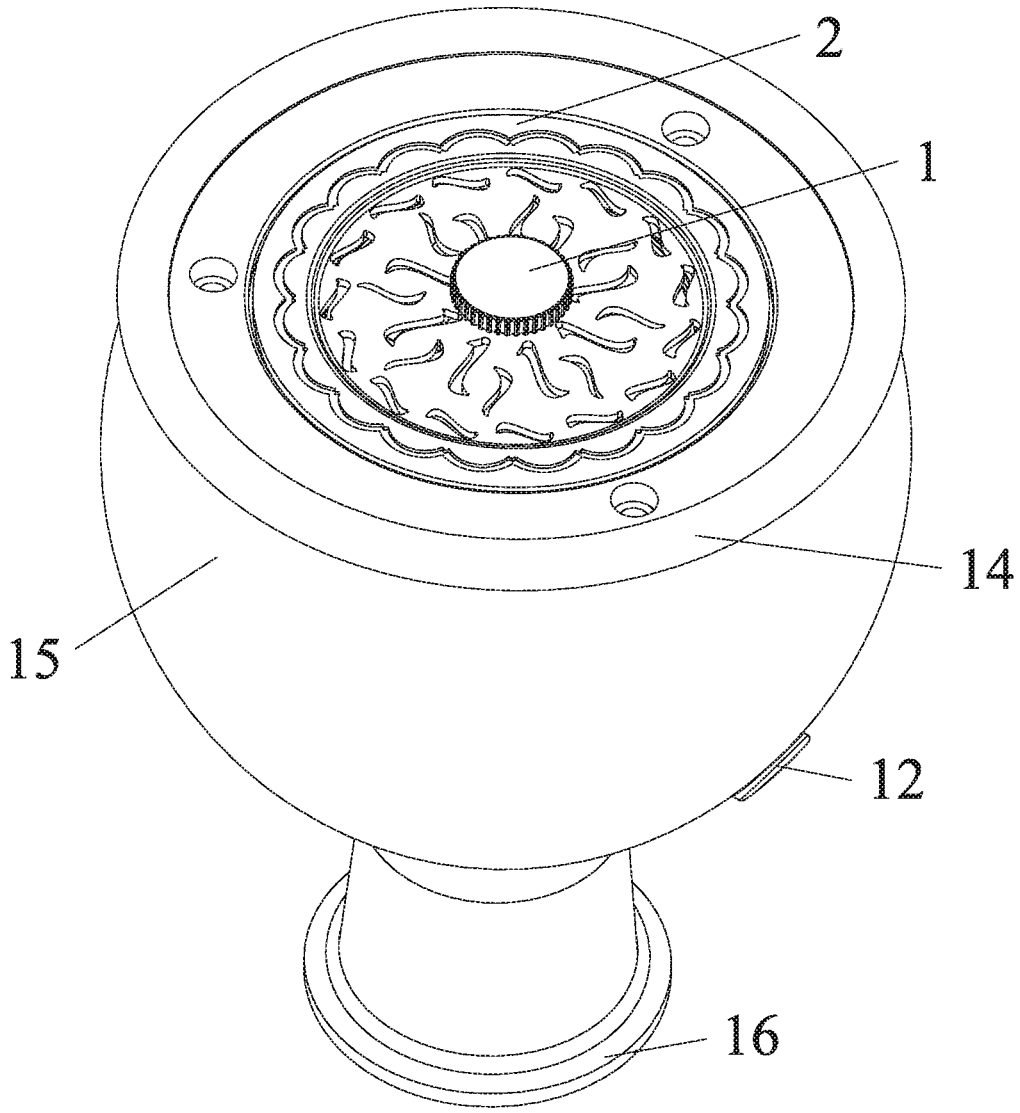
FIG. 3 is a schematic diagram of an atomization assembly according to another embodiment of the disclosure.
Figure 4:
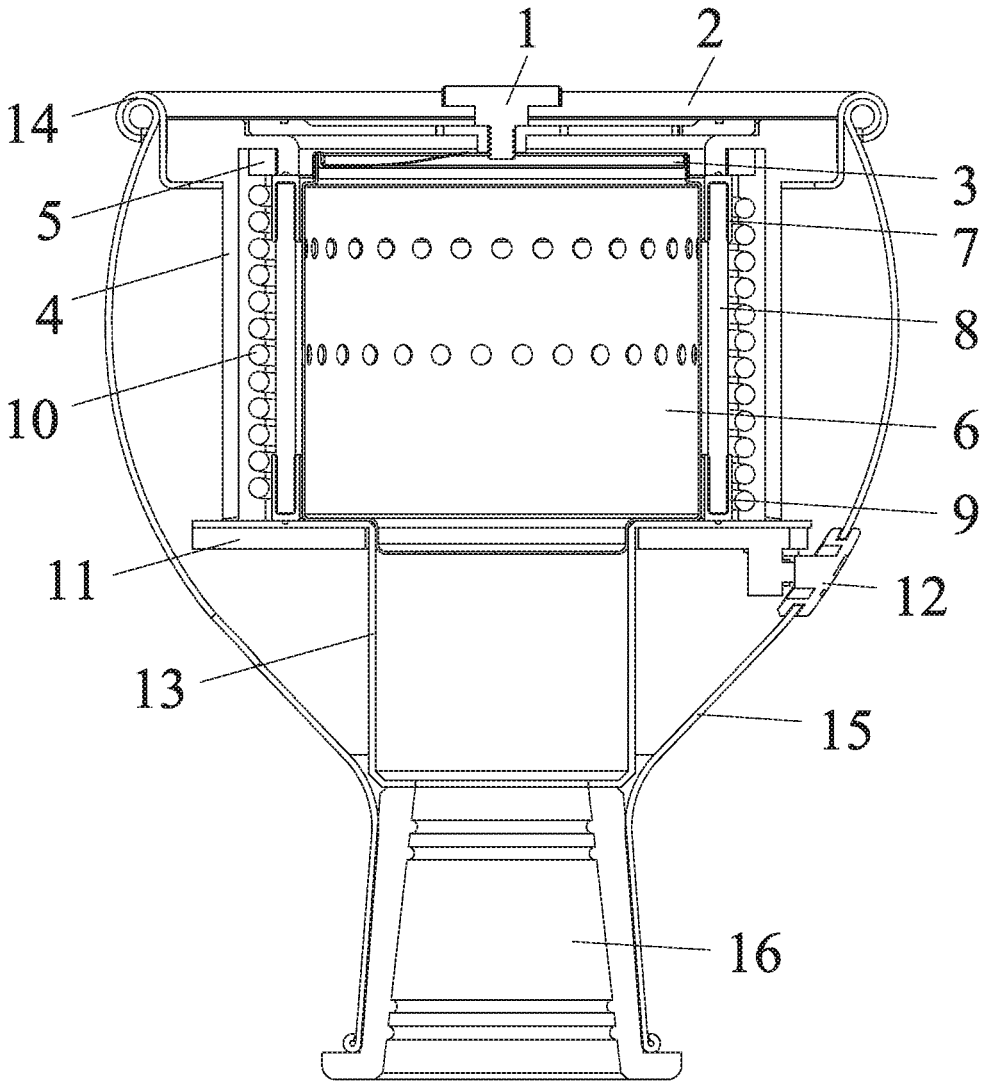
FIG. 4 is a sectional view of an atomization assembly according to one embodiment of the disclosure.
Figure 5:
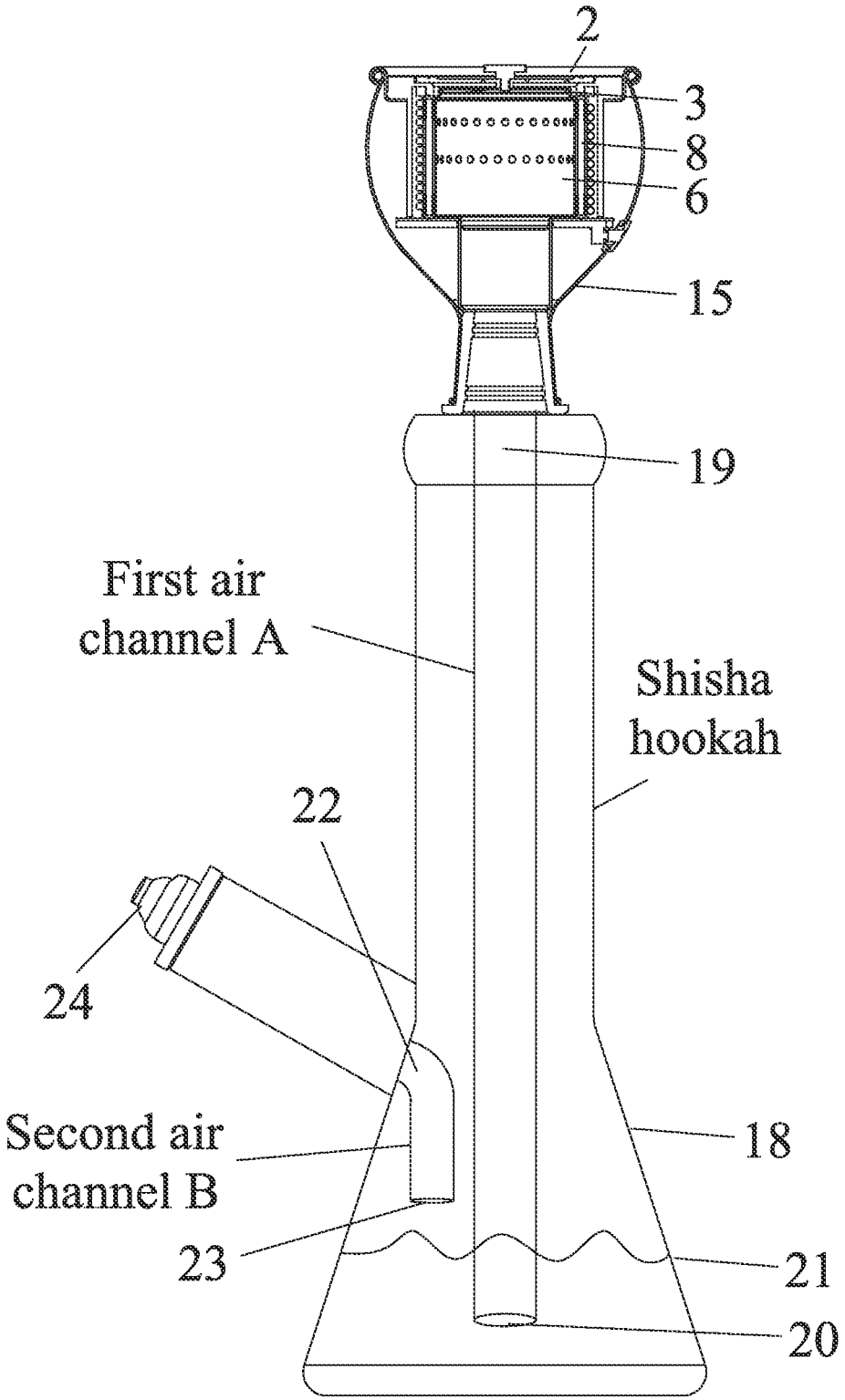
FIG. 5 is a schematic diagram of a hookah according to another embodiment of the disclosure.

As shown in FIGS. 1-5, a hookah comprises a handle 1, a first cover 2, a second cover 3, a cup sleeve 4, a magnet 5, a metal screen 6, a first seal ring 7, an isolation tube 8, a second seal ring 9, a magnetic induction coil 10, a control panel 11, a power button 12, a funnel 13, a cup edge 14, a cup body 15, a silicone seal 16. The metal screen 6 is disposed in the magnetic induction coil 10 to accommodate and vaporize a smoke material. The first seal ring 7 and the second seal ring 9 are respectively disposed on two ends of the isolation tube 8 to seal the metal screen 6. The isolation tube 8 is disposed in the magnetic induction coil 10 thus isolating and protecting the magnetic induction coil 10. The magnet 5 is disposed on the top end of the metal screen 6 and attracts the handle 1. The magnet 5, the metal screen 6, the first seal ring 7, the isolation tube 8, the second seal ring 9, and the magnetic induction coil 10 form a high frequency heating module 17. The high frequency heating module 17 is disposed in the cup sleeve 4. The control panel 11 is soldered on the magnetic induction coil 10 of the high frequency heating module 17. The power button 12 is disposed on the control panel 11. The funnel 13 is disposed on the control panel 11. The cup sleeve 4 is disposed in the cup body 15. The cup edge 14 is disposed on the periphery of the cup body 15 to fix the cup sleeve 4. The silicone seal 16 is disposed on the bottom end of the cup body 15. The second cover 3 is disposed on the top end of the high frequency heating module 17 to cover the smoke material. The first cover 2 is disposed on the cup sleeve 4 for air ventilation. The handle 1 is disposed on the first cover 2.

The hookah further comprises a water container 18, a first air channel A and a second air channel B; the first air channel comprises a first end 19 connected to the atomization assembly and a second end 20 submerged below a liquid graduation line 21 of the water container; the second air channel comprises a third end 22 connected to a suction nozzle 24 and a fourth end 23 disposed above the liquid graduation line 21; when in use, the water container 18 is filled with water; the smoke produced by the atomization assembly enters the water from the first end 19, is filtered by the water, escapes from the water, and flows to the suction nozzle 24.

It will be obvious to those skilled in the art that changes and modifications may be made, and therefore, the aim in the appended claims is to cover all such changes and modifications.

What is claimed is:

1. An atomization assembly, comprising a high frequency heating module; the high frequency heating module comprising a metal screen, an isolation tube, and a magnetic induction coil; wherein:

the metal screen has a cylindrical shape, and comprises a plurality of holes on a side wall;

the metal screen is disposed in the magnetic induction coil and is configured to heat a smoke material placed in the metal screen in a power-on state, and the smoke material is tobacco;

the isolation tube is a glass tube or a ceramic tube, and is disposed between the metal screen and the magnetic induction coil to isolate and protect the magnetic induction coil.

2. The atomization assembly of claim 1, wherein the high frequency heating module further comprises a magnet and a handle; the magnet is disposed on a top end of the metal screen and attracts the handle.

3. The atomization assembly of claim 1, wherein the high frequency heating module further comprises a first seal ring and a second seal ring respectively disposed on two ends of the isolation tube to seal the metal screen.

4. The atomization assembly of claim 3, further comprising a first cover, a second cover, and a cup sleeve; wherein the second cover is disposed on a top end of the high frequency heating module to cover the smoke material; the high frequency heating module is disposed in the cup sleeve; the first cover comprises an air vent and is disposed on the cup sleeve for air ventilation; and the handle is disposed on the first cover.

5. The atomization assembly of claim 4, further comprising a control panel, a power button, a funnel, a cup edge, a cup body, a silicone seal, wherein the control panel is soldered on the magnetic induction coil of the high frequency heating module; the power button is disposed on the control panel; the funnel is disposed on the control panel to support the smoke material; the cup sleeve is disposed in the cup body; the cup edge is disposed on a periphery of the cup body to fix the cup sleeve; and the silicone seal is disposed on a bottom end of the cup body.

6. The atomization assembly of claim 1, wherein the atomization assembly is in the shape of a cup.

7. A hookah, comprising an atomization assembly of claim 1.

8. The hookah of claim 7, further comprising a water container, a first air channel and a second air channel; wherein the first air channel comprises a first end connected to the atomization assembly and a second end submerged below a liquid graduation line of the water container; the second air channel comprises a third end connected to a suction nozzle and a fourth end disposed above the liquid graduation line; when in use, the water container is filled with water; the smoke produced by the atomization assembly enters the water from the first end, is filtered by the water, escapes from the water, and flows to the suction nozzle.

* * * * *